US006273591B1

(12) United States Patent
Albou

(10) Patent No.: US 6,273,591 B1
(45) Date of Patent: Aug. 14, 2001

(54) INDICATOR LIGHTS FOR MOTOR VEHICLES

(75) Inventor: Pierre Albou, Paris (FR)

(73) Assignee: Valeo Vision, Bobigny Cedex (FR)

( * ) Notice: Subject to any disclaimer, the term of this patent is extended or adjusted under 35 U.S.C. 154(b) by 0 days.

(21) Appl. No.: 09/109,238

(22) Filed: Jun. 30, 1998

(30) Foreign Application Priority Data

Jun. 30, 1997 (FR) ..... 97 08194

(51) Int. Cl.[7] ..... F21V 5/00

(52) U.S. Cl. ..... 362/333; 362/520; 362/522; 362/332; 362/334; 362/340; 362/337; 362/326; 362/311

(58) Field of Search ..... 362/520, 522, 362/311, 326, 332, 333, 330, 337, 339, 334; 359/455, 456, 457

(56) References Cited

U.S. PATENT DOCUMENTS 4,654,761 * 3/1987 Walsh ..... 362/80
4,752,116 * 6/1988 Sekiguchi ..... 350/128
5,945,916 * 8/1999 Collot ..... 340/468

FOREIGN PATENT DOCUMENTS 0 784 185 7/1997 (EP) .

* cited by examiner

*Primary Examiner*—Sandra O'Shea
*Assistant Examiner*—Bertrand Zeade
(74) *Attorney, Agent, or Firm*—Morgan & Finnegan, LLP

(57) ABSTRACT

An indicator light for a motor vehicle has a point source, an intermediate screen which receives the light directly from the source, and a cover glass outside the screen. The intermediate screen comprises a series of optical cells, each of which has, on an internal face, a curved surface for straightening and spreading the light. Each cell further has, on an outer face, a set of at least two flat facets which are oblique with respect to a plane of the intermediate screen.

17 Claims, 3 Drawing Sheets

INDICATOR LIGHTS FOR MOTOR VEHICLES

FIELD OF THE INVENTION

The present invention relates to indicator lights, or indicating lights, for motor vehicles, and more particularly to indicator lights which include a light source which is substantially a point source, an intermediate screen, and a cover glass, or lens, in front of the screen, the intermediate screen and the cover lens both being interposed in the path of an essentially parallel beam emitted by the indicator light.

BACKGROUND OF THE INVENTION

Such an indicator light is known in general terms, in which the intermediate screen, and sometimes the cover lens, include optical arrangements for giving the indicator light the desired photometry and, optionally, a particular styling appearance.

A first conventional approach consists of giving the intermediate screen a Fresnel lens which is focused on the light source, so as to restitute, at the exit of the indicator light, an essentially parallel beam. In that case, the cover lens is formed with billet-shaped or toroidal elements for diffusion of the light both horizontally and vertically. The outward aesthetic appearance of such a known type of indicator light is not very original.

A second approach consists of providing, on the intermediate screen, a set of deflecting prisms which are arranged as tiles, to give the indicator light a sparkling appearance while satisfying the regulations as regards photometry. This sparkling appearance, which does give the indicator light some novelty from the aesthetic point of view, has the disadvantage that it has an appearance, both when extinguished and when lit, which varies in a very marked manner when the observer moves around the vehicle. In addition, this sparkling appearance is often associated with a downmarket product.

DISCUSSION OF THE INVENTION

An object of the present invention is to provide an indicator light of the type mentioned above, which, while satisfying the photometric regulations and being, where appropriate, without any light flux recuperator, has a novel visual appearance both when extinguished and when lit, which hardly varies when the observer moves around the vehicle.

More precisely, the invention aims to provide an indicator light which, when lit, gives the impression of having a plurality of individual elementary light sources in the same way as indicator lights with light emitting diodes, over a wide range of angles of observation.

According to the invention, an indicator light for a motor vehicle, comprises a substantially point source, of light an intermediate screen receiving light directly from the light source, and a cover glass situated outside the screen, wherein the intermediate screen includes a series of optical cells each comprising, on an internal face, a curved surface for straightening and spreading the light, and, on an external surface, a set of at least two flat facets which are oblique with respect to a plane of the intermediate screen.

Any one or more of the following preferred features of the invention, which are in no way limiting, may be applied to an indicator light according to the invention:

the cells, defined by a curved surface and a set of facets associated therewith, have a horizontal pitch and a vertical pitch each pitch being in the approximate range 5 to 30 mm;

the curved surfaces are convex;

the facets in a set are hollow;

the facets in a set are bounded laterally by relief facets which are slightly inclined with respect to the general direction of emission of the light;

the facets are joined together along horizontal straight lines;

each set of facets consists of two oblique facets which are symmetrical to a median line of a corresponding cell;

each set of facets consists of a central facet extending substantially at right angles to the general direction of emission, together with two oblique facets lying on either side of the central facet and being symmetrical with respect to a median line of a corresponding cell;

the obliquity of the facets is determined in such a way as to correct a spread provided by the corresponding curved surface, either in the vertical direction only, or in the horizontal direction only, so that the screen provides horizontal spread and a vertical spread in accordance with regulations, the horizontal and vertical spreads being different from each other;

the cover glass is smooth on both of its faces and extends substantially parallel to the intermediate screen.

Further features and advantages of the invention will appear from the following detailed description of preferred embodiments of the invention, which are given by way of non-limiting example only and with reference to the accompanying drawings.

DESCRIPTION OF PREFERRED EMBODIMENTS OF THE INVENTION

Figure 1:
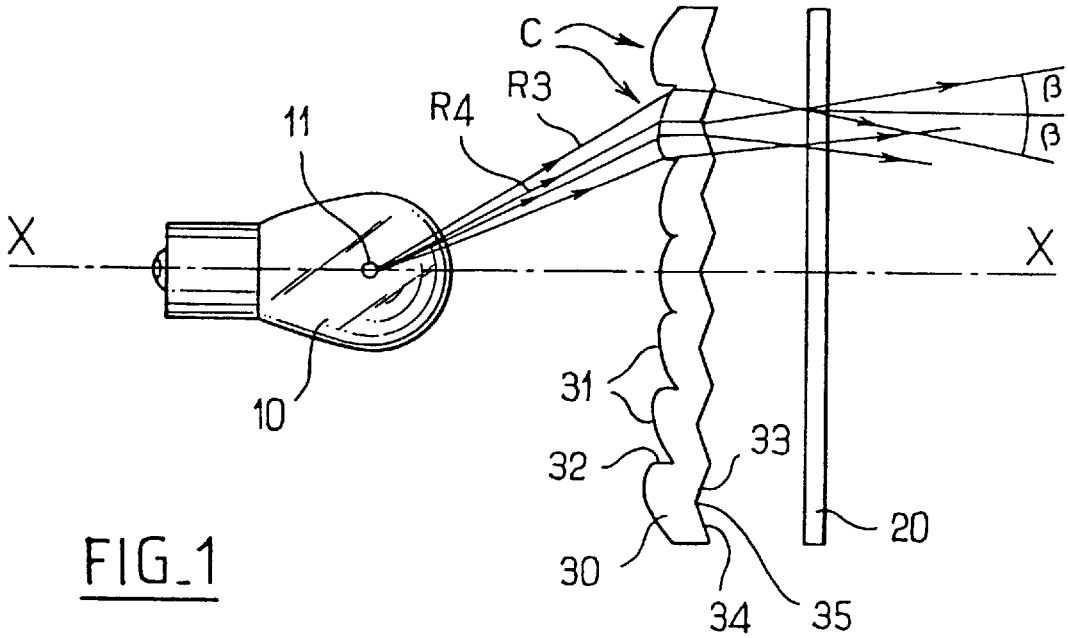
FIG. 1 is a view in axial vertical cross section of an indicator light in accordance with the present invention.
Figure 2:
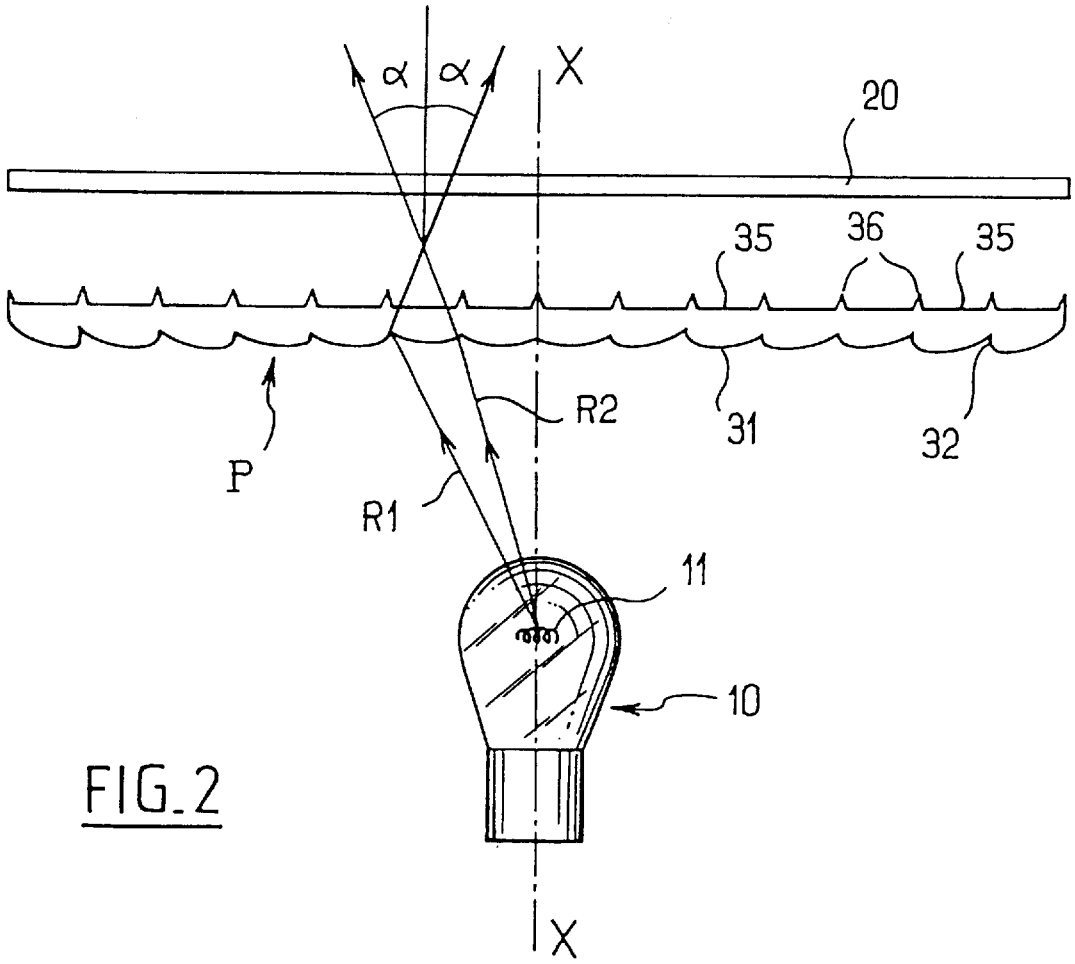
FIG. 2 is a view in horizontal axial cross section of the indicator light of FIG. 1.

With reference first to FIGS. 1 and 2, there is shown an indicator light which comprises: a light source 10, which is typically a filament lamp 11; an intermediate screen 30; and a cover glass or lens 20, which is preferably smooth on both of its faces, whether or not such faces are parallel to the intermediate screen 30. In the present example, the intermediate screen 30 and the cover lens 20 lie in planes which are essentially at right angles to the general direction X—X of emission of light by the indicator light, which is defined in the present example by the axis of the lamp 10. It will, however, be clearly understood that, although the screen 30 and cover glass 20 presented here are generally planar, curved profiles may also be envisaged.

The intermediate screen 30, in this example, includes on its internal face a plurality of generally convex surfaces 31 which are defined within rectangular contours, such contours being squares and defining individual optical cells.

As will be presented more clearly, in order to give the indicator light, when illuminated, a marked multi-source appearance, i.e. the appearance of clearly having more than one light source (despite the fact that the source 10 is effectively a point source), the size of the cells is substantially greater than that of the billet-shaped or toroidal elements conventionally used in intermediate screens or cover lenses. Thus, whereas these optical elements in known arrangements are generally dimensioned so that their sides are of the order of 2 to 4 mm, the optical elements in lights according to the invention have a size which is selected to be preferably between 5 and 30 mm. The particular form of each surface 31 provides two functions. The first is to straighten the light coming directly from the light source 10, in order to put it in a mean direction which is substantially parallel to the general emission direction X—X. The second, by virtue of the divergence which follows the initial convergence created by the convex surface (this divergence taking place beyond the intermediate screen 30), is to ensure, firstly, horizontal spreading of the light as required by photometric regulations, and secondly, vertical spreading of the light which differs from the value required by such regulations, and which in the present case is a greater vertical spread than that which is required.

In one particular case, the vertical spread produced by each surface is identical to the horizontal spread. Thus, for example, if a regulation requires that the horizontal spread of the light rays be in the range ±20°, and that the vertical spread be in the range ±10°, then the surfaces 31 may selected to provide deflection which is identical, and is at least ±20° in both directions.

In the remainder of this description, a general definition will be given for one example of a surface 31 which enables the aforementioned objective to be achieved, and in particular to ensure that the horizontal and vertical spread will preferably be homogeneous at all of the cells in the intermediate screen. This general definition, which will be expressed mathematically, can be used in systems of design and manufacture which are computer assisted.

It will be noted here that the thickness of the intermediate screen 30, at the contour of each cell, varies between one cell and adjacent cells, and therefore relief surfaces 32 exist, between the internal faces of the cells, which may, for example, be treated, by grinding, to minimize the effects of parasitic radiation that passes through them. These relief surfaces 32 may also be eliminated by providing a depthwise offset between the input faces 31 of the various cells, such an offset comprising an intermediate screen having a thickness that varies accordingly.

As has been indicated above, the vertical spread produced by each input surface 31 of the intermediate screen differs from what is necessary, in this case, being greater than necessary. This vertical spread must therefore be restored to the required value, in this case, ±10°. For this purpose, there is provided on the outer face of the intermediate screen, and associated with each convex surface 31, a set of flat facets which extend parallel to a horizontal straight line and at right angles to the axis X—X of the indicator light.

In the present case, two facets are provided in the set, namely an upper facet 33 and a lower facet 34, these two facets 33 and 34 being inclined, preferably symmetrically, together defining a hollow surface which has a horizontal edge 35 at its base.

The purpose of the upper and lower facets 33 and 34 is to attenuate the vertical deflection of the radiation provided by the associated internal surface 31. Thus, as is shown in FIG. 2, two rays R1 and R2, situated at the same height and incident on the same cell C in the vicinity of its side edges, will be deflected laterally, mainly by the input surface 31, so that at exit the from the intermediate screen, a spread of ±α, which is the required horizontal spread, is obtained. On the other hand, as is shown in FIG. 1, two rays R3 and R4, situated one in direct line above the other and incident on the same cell C in the region of the upper and lower edges of an inclined facet 33 or 34, will first be deflected vertically by an excessive amount by the input surface 31, and will then be corrected by an appropriate amount by the same facet, to obtain a final vertical spread ±β, which is the vertical spread required.

The inclination of the facets 33 and 34 is for example determined, either by calculation or by experiment, as a function of what has been described above. In this regard, it will be noted that the design of the various cells can be achieved firstly by presetting the inclination of the facets 33 and 34 (this inclination being preferably identical for all of the cells, so as to give the extinguished indicating light a homogeneous appearance); and then, by determining the form of each input surface 31 so that the inclination of the facets 33 and 34 can subsequently be matched to the required alteration of the spread in the vertical direction.

A general definition of one example of input surfaces 31 will now be given, the surfaces 31 being able to be used in an intermediate screen of an indicator light according to the invention. This screen may be used in particular in the case where the dimensions and the inclinations of the facets 33 and 34 are prerequisites.

Figure 6:
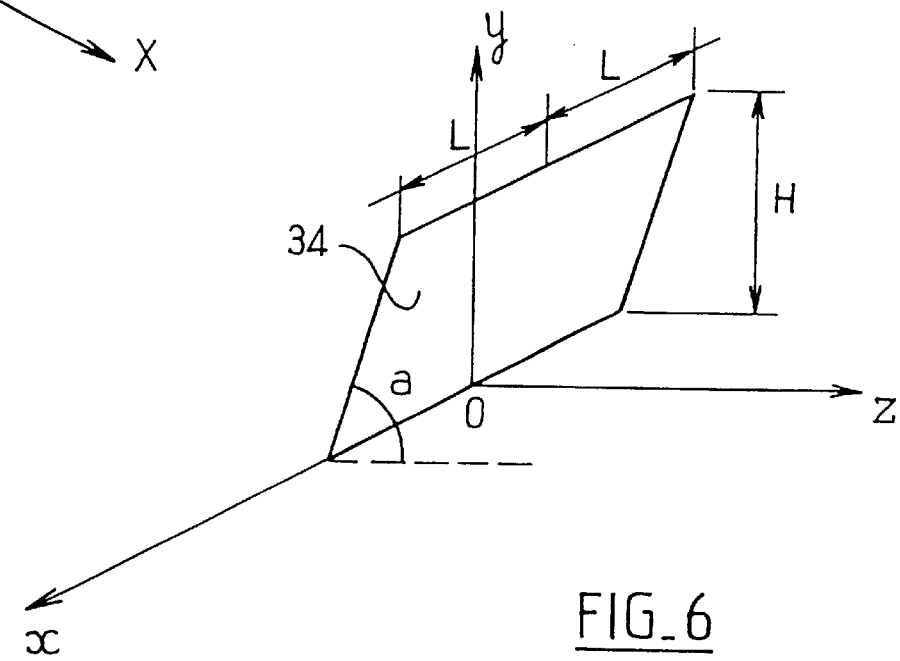
FIG. 6 shows diagrammatically one facet of one cell in the intermediate screen shown in FIG. 3.

Reference is accordingly made to FIG. 6, which shows an output facet 33 of a cell having the following parameters:

H=height

L=half width a=inclination with respect to the horizontal.

The other parameters are as follows:

h+, h−: required angular aperture of the beam delivered by the indicator light in the horizontal direction;

v+, v−: desired angular aperture of the beam delivered by the indicator light in the vertical direction;

n: the refractive index of the material of the intermediate screen 30;

Sx, Sy, Sz: the coordinates of the light source in the cartesian grid (0, x, y, z) shown in FIG. 6, in which 0z is the horizontal direction parallel to the axis of the vehicle, 0y is the vertical direction, and 0x is the lateral direction.

The equation for the input surface 31 is obtained in a parametric form as a function of (x,y)∈[−L,+L]×[0,H). In order to obtain this equation, the following intermediate notations are used in order to simplify the written expressions:

$$z = y/\tan(a)$$

$$Cx = L\cdot(\tan(h+)+\tan(h-))/(\tan(h+)-\tan(h-))$$

$$Cy = H\cdot(1-(\tan(v-)/\tan(a))\cdot\tan(v+)/(\tan(v+)-\tan(v-))$$

$$Cz = 2L/(\tan(h+)-\tan(h-))$$

$$R1 = (Cy/\tan(v+))-Cz$$

$$Rp = R1\cdot(Cz-z)\Big/\sqrt{((Cz-z)^2+(Cx-x)^2)}$$

$$r_z = \sqrt{(1/(1+((Cx-x)/(Cz-z))^2+((Cy-y)/(Cz+Rp-z))^2))}$$

$$r_x = r_z\cdot(Cx-x)/(Cz-z)$$

$$r_y = r_z\cdot(Cy-y)/(Cz+Rp-z)$$

$$\lambda = -(-\cos(a)\cdot r_y+\sin(a)r_z)+\sqrt{((-\cos(a)\cdot r_y+\sin(a)r_z)^2+n^2-1)}$$

$$Q_{Mx} = Cx+R1\cdot r_x\Big/\sqrt{(r_x^2+r_z^2)}$$

-continued $$Q_{Mz} = Cz + R1 \cdot r_z \Big/ \sqrt{(r_x^2 + r_z^2)}$$

In addition, let:

$$M = \begin{pmatrix} x \\ y \\ z \end{pmatrix}; Q_M = \begin{pmatrix} Q_{Mx} \\ Cy \\ Q_{Mz} \end{pmatrix}; \vec{i} = 1/n \begin{pmatrix} rx \\ -\lambda\cos(a) + r_y \\ \lambda\sin(a) + r_z \end{pmatrix}$$

The term $\mu$ designates a negative solution of the following second degree equation:

$$(n^2-1)\mu^2+2\mu.\{v.(\delta_0-11MQ_M11)-SM.i\}+((\delta_0-11MQ_M11^2)-11SM11^2=0$$

The input surface is therefore defined by the set of the points N such that:

$$MN=\mu.1$$

It will be observed here that the parameter $\delta_0$ determines the thickness of the intermediate screen 30 at the center of the cell under consideration. Its value is chosen so that the thickness never becomes zero, and remains higher than a minimum value which is established as a function of considerations relating to the molding of the component by injection, such as cycle time and molding pressure and.

The cover lens 20 in this example, is smooth on both faces and it therefore, does not affect the optics; nor does it affect the appearance of the indicator light.

If the indicator light is to emit colored light, the color is preferably given either by the bulb of the lamp 10, or by a colored globe surrounding the lamp, or by the intermediate screen 30 being tinted appropriately; or, again, it may be given by the cover lens 20.

The indicator light, as described above, has a certain number of advantages, both when it is illuminated and when it is extinguished. First, when it is illuminated, the combination of each input surface and the associated flat facets create a plurality of real secondary light sources, all having similar intensities and remaining visible within a wide range of viewing angles. This, gives the illusion of a multi-lamp indicator light, such as light sources that are light emitting diodes.

Figure 4:
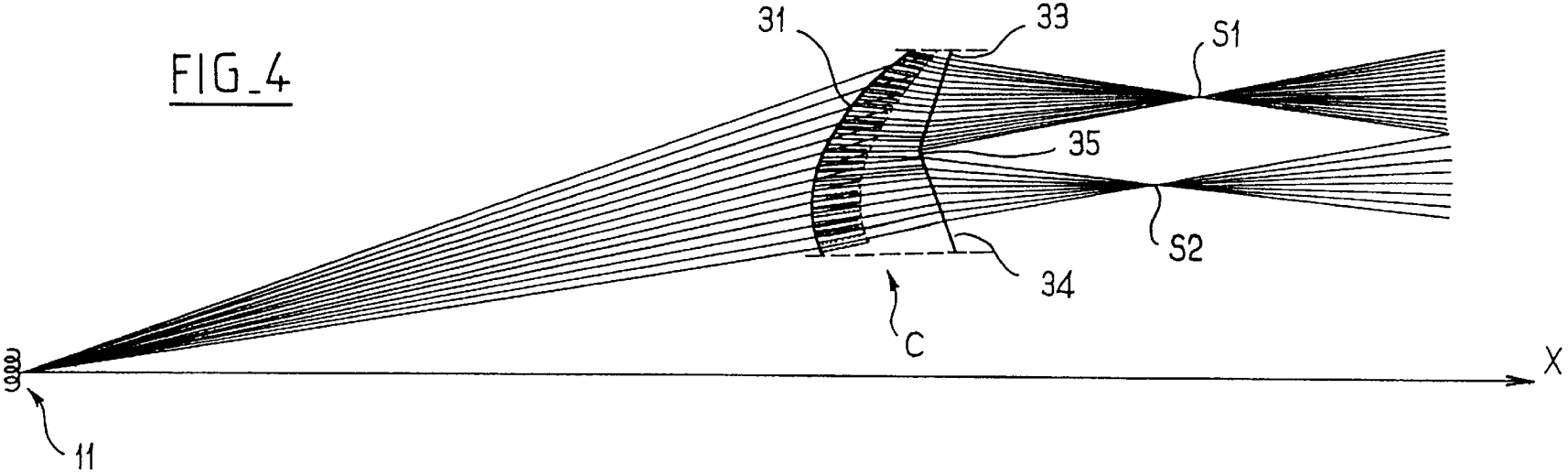
FIG. 4 is a vertical axial cross sectional view showing the optical behaviour of the cell shown in FIG. 3.

More precisely, it will be noted in FIG. 4 that each cell C creates in front of the cell, and, for example, in the vicinity of the cover lens 20, two secondary light sources S1 and S2, each of which gives illumination within a solid angle corresponding substantially to the whole field of illumination to be covered by the indicator light.

In addition, when the observer moves in front of the indicator light, all of the secondary sources are displaced in the same way, and retain similar intensities, which tends to reinforce the above mentioned illusion.

Moreover, the regular character of the motifs on the outer face of the intermediate screen give the indicator light the appearance of a precious stone having facets. This is significant from the styling point of view, because it is radically different from the objectives which are normally looked for in the material.

Figure 3:
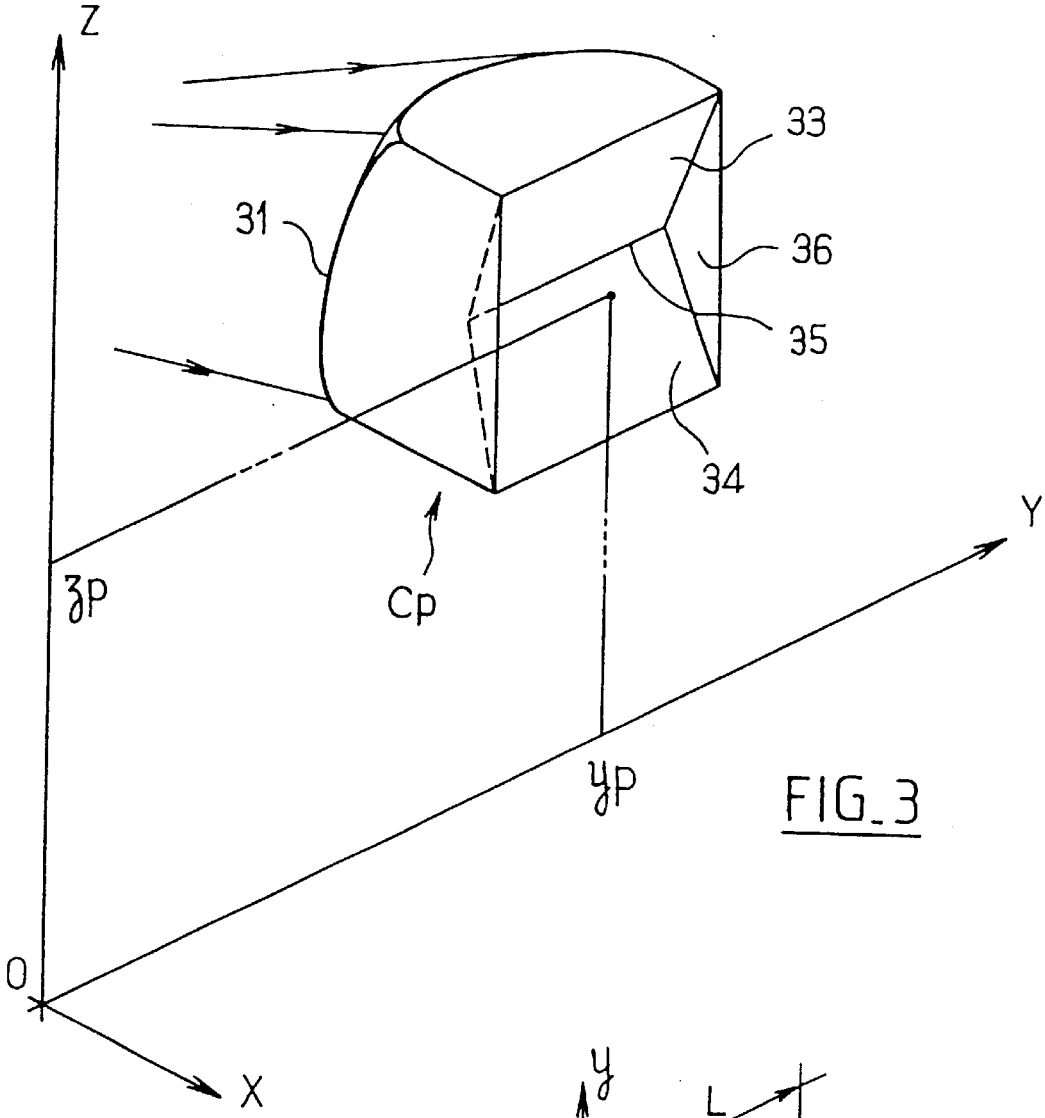
FIG. 3 is an enlarged perspective view of an individual cell of the intermediate screen.

In this connection, it will be noted in FIGS. 1 to 3 that each set of hollow facets 33, 34 associated with a spherical surface is bounded laterally by two slightly oblique relief surfaces, which contribute further to the above mentioned precious stone effect because of the ribs 36, which have acute angles defined by two adjacent relief surfaces.

Figure 5:
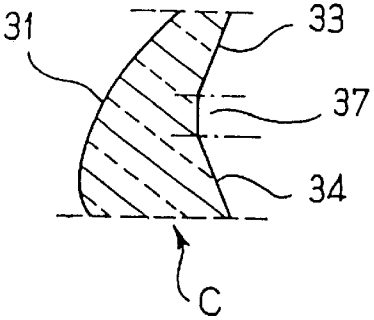
FIG. 5 is a vertical axial cross sectional view of a cell in another embodiment of the invention.

Of course, numerous modifications may be made to what is described in the above description. In one of these modified versions, which is shown in FIG. 5, the inner face of the intermediate screen 30 is unchanged, while three facets, instead of two, are associated with each individual surface 31. These three facets include and a inclined facets 33 and 34 described above, the third facet being a central facet 37, separating the facets 33 and 34 at right angles to the general direction of emission X—X. This central facet 37 is arranged to keep a large quantity of light in the axis of the indicator light, to satisfy certain photometric regulations.

In a second modified version, not shown, each cell of the intermediate screen has four facets on its outer face, namely two central facets slightly inclined with respect to the plane of the intermediate screen, and two external facets, which are an upper and a lower one respectively and which have a sharper inclination. This particular version is especially suitable for the photometry required in reversing lights by the regulations. It will be noted that in every case, the facets are joined together, preferably with continuity of the first order, i.e. having no dips or steps between them.

In a further version, the facets arranged on the outer side of the intermediate screen 30 are no longer hollow, but project outwards. In particular, his version is applicable where it is desired to increase the spread provided initially by the associated internal surfaces 31 using these facets. For example, an elementary internal surface 31 can be designed to provide a spread of ±10° both in the horizontal direction and in the vertical direction. Advantageously, the facets can be used to increase the horizontal spread, so that it reaches, for example, ±20°. In this case, the facets must be parallel to a vertical straight line, being joined together at a level of a vertical central edge.

In yet another version, the convex surfaces 31 of the foregoing embodiments are replaced by concave surfaces. As a result of this, the radiation which passes through these diopters is divergent instead of convergent.

The associated external facets do, however, perform the same function, namely, that of correcting spread in the vertical or horizontal direction, as is performed by the associated input surface 31.

It will be noted that, in this case, the secondary sources are no longer real sources situated outside the intermediate screen 30, but are instead virtual sources situated on the inner side of the screen. As to the impression of a multi-source indicator light which is given, this version is equally good.

In still a further version, the internal surfaces 31 are concave and the facets are inclined, being similar in their distribution to those in FIG. 2, and being arranged to project upwards. In this case, also, the spherical surfaces provide a suitable amount of spread in one of the directions, while the combination of the input surfaces and the facets provides suitable spread in the other direction.

Finally, one possible modified embodiment consists of combining, in the intermediate screen 30, incident light of which a part comes directly from the source 11 as in the embodiment described above, with another part of the incident light coming from a flux recuperator which is adapted to produce radiation essentially parallel to the axis X—X. In this case, the cells C concerned with the direct radiation are designed in the manner described above, while the cells C concerned with the parallel radiation have input surfaces 31 in which no general straightening of the light takes place. These input surfaces may then be, for example, spherical or toroidal.

The present invention is of course in no way limited to the embodiment described and shown, nor to the various modified versions described above; a person skilled in the technical field to which the invention relates can apply any suitable modification in conformity with the spirit of the invention.

What is claimed is:

1. A motor vehicle indicator light, comprising: a light source being substantially a point source; a cover glass; and an intermediate screen between the light source and the cover glass for directly receiving light from the light source; the screen comprising a series of optical cells, each of said cells having an internal face facing said light source and an external face facing said cover glass, the internal face of each of said cells defining a curved surface for straightening and spreading the light, and the external face of each of said cells defining a set of at least two transparent flat facets, the facets being angled with respect to each other.

2. An indicator light according to claim 1, wherein the cells in said series of cells define a horizontal and a vertical pitch, the horizontal pitch and the vertical pitch each being approximately between 5 and 30 mm.

3. An indicator light according to claim 1, wherein the curved surfaces are convex.

4. An indicator light according to claim 1, wherein the facets in said set are hollow.

5. An indicator light according to claim 4, defining a general direction of emission of the light, wherein the intermediate screen further defines relief facets slightly inclined to the general direction and laterally bounding the facets of the set.

6. An indicator light according to claim 1, wherein the intermediate screen further defines a plurality of horizontal straight lines constituting junctions between the facets.

7. An indicator light according to claim 1, wherein each cell defines a median line of the cell, each said set of facets consisting of two oblique facets being symmetrical with respect to the median line of a corresponding cell.

8. An indicator light according to claim 1, defining a general direction of emission of the light, wherein each of said cells define a median line of the cell and each of said set of facets further comprise a central facet extending substantially at right angles to the general direction, the two oblique facets lying on either side of the central facet and being symmetrical with respect to the median line of the corresponding cell.

9. An indicator light according to claim 1, wherein a facet of a cell corrects the spread provided by the curved surface of the cell, in a single direction, the single direction being selected from the group consisting of a vertical direction and a horizontal direction, wherein the intermediate screen provides a horizontal spread and a vertical spread in accordance with regulations, said horizontal spread differing from said vertical spread.

10. An indicator light according to claim 1, wherein the cover glass is smooth on both the external and internal faces and is substantially parallel to the intermediate screen.

11. A motor vehicle indicator light, comprising:

a source of light;

a cover glass, and an intermediate screen between the source of light and the cover glass for receiving light from the source of light; and the intermediate screen comprising a series of optical cells, each of said cells having an internal face facing said source of light and an external face facing said cover glass, the internal face defining a curved surface for straightening and spreading the light, and the external face defining a set of two transparent flat facets, the two facets being angled with respect to each other for adjusting the spread of the light passing through the two facets.

12. An indicator light of claim 11, wherein each cell creates two secondary light sources.

13. An indicator light according to claim 11, defining a general direction of emission of the light, wherein the intermediate screen further defines relief facets slightly inclined to the general direction and laterally bounding the facets of the set.

14. An indicator light according to claim 11, defining a general direction of emission of the light, wherein each of said cells define a median line of the cell and each set of facets further comprises a central facet extending substantially at right angles to the general direction, the two angled facets lying on either side of the central facet and being symmetrical with respect to the median line of the corresponding cell.

15. An indicator light according to claim 11, wherein the a facet of a cell corrects the spread provided by the curved surface of the cell, in a single direction, the single direction being selected from the group consisting of a vertical direction and a horizontal direction, wherein the intermediate screen provides a horizontal spread and a vertical spread in accordance with regulations, said horizontal spread differing from said vertical spread.

16. A motor vehicle indicator light, comprising:

a source of light;

a cover glass; and an intermediate screen between the source of light and the cover glass for receiving light from the source of light; and the intermediate screen comprising a series of optical cells, each of said cells having an internal face facing said source of light and an external face facing said cover glass, the internal face defining a curved surface for straightening and spreading the light, and the external face defining a set of two transparent flat facets, the two facets being angled with respect to each other for adjusting the spread of the light passing through the two facets, and the external surface defining relief facets slightly inclined with respect to a general direction of emission of the light, the relief facets laterally bounding the facets of the set.

17. A motor vehicle indicator light, comprising:

a source of light;

a cover glass; and an intermediate screen between the source of light and the cover glass for receiving light from the source of light; and the intermediate screen comprising a series of optical cells, each of said cells having an internal face facing said source of light and an external face facing said cover glass, the internal face defining a curved surface for straightening and spreading the light, and the external face defining a set of two transparent flat facets, the two facets being angled with respect to each other for adjusting the spread of the light passing through the two facets, and the set further comprising a central facet extending substantially at right angles to a general direction of the emission light, the two angled facets lying on either side of the central facet and being symmetrical with respect to a median line of the corresponding optical cell.

* * * * *